US009352876B2

(12) United States Patent
Muirhead

(10) Patent No.: US 9,352,876 B2
(45) Date of Patent: May 31, 2016

(54) PALLET WITH IMPACT GUARDS

(71) Applicant: Scott Arthur William Muirhead, Langley (CA)

(72) Inventor: Scott Arthur William Muirhead, Langley (CA)

(73) Assignee: NEXTREME, LLC, Langley, British Columbia (CA)

( * ) Notice: Subject to any disclaimer, the term of this patent is extended or adjusted under 35 U.S.C. 154(b) by 0 days.

(21) Appl. No.: 14/556,187

(22) Filed: Nov. 30, 2014

(65) Prior Publication Data

US 2016/0114936 A1 Apr. 28, 2016

Related U.S. Application Data

(60) Provisional application No. 61/963,582, filed on Dec. 9, 2013.

(51) Int. Cl.

*B65D 19/00* (2006.01)
*B65D 19/18* (2006.01)
*B65D 19/38* (2006.01)

(52) U.S. Cl.

CPC ..... *B65D 19/18* (2013.01); *B65D 19/38* (2013.01); *B65D 2519/00034* (2013.01); *B65D 2519/00069* (2013.01); *B65D 2519/00288* (2013.01); *B65D 2519/00452* (2013.01); *B65D 2519/00567* (2013.01); *B65D 2519/00796* (2013.01)

(58) Field of Classification Search

CPC ..... B65D 2519/00069; B65D 2519/00034; B65D 2519/00104; B65D 2519/00243; B65D 2519/00273; B65D 2519/00303; B65D 2519/00447; B65D 2519/00552; B65D 2519/00567; B65D 2519/00268; B65D 2519/0094; B65D 19/38

USPC ..... 108/901, 902, 56.1, 56.3, 51.11, 57.25, 108/57.26, 57.27, 57.33, 57.34; 206/386, 206/599, 600

See application file for complete search history.

(56) References Cited

U.S. PATENT DOCUMENTS

| | | | | | |
|---|---|---|---|---|---|
| D238,862 | S | | 2/1976 | Hewson | |
| 4,128,253 | A | * | 12/1978 | Powers | 280/79.11 |
| 4,604,014 | A | * | 8/1986 | Frano | 411/338 |
| 4,715,294 | A | | 12/1987 | Depew | |
| D301,079 | S | | 5/1989 | DePew | |
| 5,076,175 | A | | 12/1991 | Whatley, II | |
| 5,320,048 | A | | 6/1994 | Feiner | |
| 5,402,735 | A | | 4/1995 | DeJean | |
| 5,487,343 | A | | 1/1996 | Phillips | |
| 5,582,113 | A | * | 12/1996 | Langenbeck | 108/57.26 |
| 5,673,629 | A | | 10/1997 | Ginnow | |
| 5,829,364 | A | * | 11/1998 | Urbach | 108/56.1 |
| 6,408,768 | B1 | | 6/2002 | Giampavolo et al. | |
| 6,516,730 | B1 | | 2/2003 | Mason | |

(Continued)

*Primary Examiner* — Janet M Wilkens
(74) *Attorney, Agent, or Firm* — Price & Adams, P.C.

(57) ABSTRACT

A pallet structure that resists damage sustained by prior art pallets in pooled pallet distribution includes a deck and a base separated by opposed block structures spaced to accommodate fork tines, pallet jacks and other pallet moving equipment. The block structures are inset from the boundary established by the outer dimensions of the pallet. Impact guards protect the block structures against impacts that could pierce the walls of the block structures allowing foreign materials to enter an interior space of the deck, base or block structure. The impact guards surround the block structures preventing impacts from all sides. The exterior surfaces of the impact guards, at the four pallet corners, form a continuous vertical wall which extends from the top of the deck to bottom of the base.

23 Claims, 5 Drawing Sheets

(56) References Cited

U.S. PATENT DOCUMENTS

| | | | | |
|---|---|---|---|---|
| D547,024 | S | 7/2007 | Brefka et al. | |
| 7,342,496 | B2 * | 3/2008 | Muirhead | 340/572.1 |
| 7,748,329 | B2 * | 7/2010 | Baltz | 108/56.1 |
| 7,948,384 | B1 * | 5/2011 | Kennedy | 340/572.8 |
| 8,077,040 | B2 * | 12/2011 | Muirhead | 340/572.1 |
| D665,145 | S | 8/2012 | Kessler | |
| 8,291,837 | B2 | 10/2012 | Kirkpatrick | |
| 8,291,839 | B2 | 10/2012 | Apps et al. | |
| D675,805 | S | 2/2013 | Randall et al. | |
| 8,584,599 | B2 | 11/2013 | Bravo | |
| 8,887,646 | B2 | 11/2014 | Skudutis et al. | |
| 2002/0030597 | A1 * | 3/2002 | Muirhead | 340/572.1 |
| 2005/0170238 | A1 * | 8/2005 | Abu-Isa et al. | 429/82 |
| 2008/0053342 | A1 * | 3/2008 | Muirhead | 108/57.25 |
| 2009/0050029 | A1 * | 2/2009 | Ogburn | 108/51.11 |
| 2010/0182150 | A1 * | 7/2010 | Edelstain | 340/572.8 |
| 2010/0251941 | A1 * | 10/2010 | Muirhead | 108/57.27 |
| 2010/0288843 | A1 * | 11/2010 | Arnesen et al. | 235/492 |
| 2013/0189470 | A1 * | 7/2013 | Roberts, Jr. | 428/71 |

* cited by examiner

PALLET WITH IMPACT GUARDS

CROSS-REFERENCE TO RELATED APPLICATIONS

The present application claims priority from U.S. Provisional Application No. 61/936,582 filed Dec. 9, 2013.

BACKGROUND OF THE INVENTION

Field of the Invention

The present invention relates to material handling pallets, and in particular to a plastic pallet having superior longevity compared to existing wood and prior art plastic pallets.

Description of the Prior Art

Pallets of all description are in one way or another involved in the supply chains and logistic channels that deliver the vast majority of all products that are relied upon by society to exist. Wood pallets of many dimensions have been used in North America since after WWII due to the abundance and low cost of wood. The largest user groups of wood pallets over time have established standard pallet dimensions for each of their respective industry logistic networks. The largest user group of pallets in North America established a 48×40 inch pallet dimension standard may years ago, so that today most pallet loads delivered to distribution centers and supermarket stores use a 48×40 inch pallet. So many 48×40 inch wood pallets were used by industry that there was an opportunity for a company to create a pool of 48×40 inch wood pallets that could be rented for a uniform nationwide fee structure in sufficient quantity and convenience. Pallet pooling functions as an alternative to buying white wood pallets offered by hundreds if not thousands of pallet manufacturers scattered throughout North America at different prices and quality levels determined by regional market conditions. One such company that capitalized on the opportunity to supply a pooled wood pallet in competition with the independent white wood pallet manufacturers was Brambles, an Australian company, which through its subsidiary CHEP USA became the predominant pallet rental company with +/−100 million 48×40 inch wood pallets for rent in North America.

Wood pallets however fall apart due to wear and tear in use so that wood pallet pooling companies have to charge their customers a significant pallet rental fee that includes the cost of required repeated repair of the wood pallet for continued re-use. It is commonly understood +/−34 percent of the wood pallet rental fee is attributed to wood pallet maintenance. Plastic pallets have been proposed to replace wood pallets. Plastic pallets are understood to be less prone to damage, and despite their original higher cost, have a lower cost in practice than wood pallets. In addition, plastic pallets have a residual value equal to 75 percent of the cost of their virgin plastic material content, so that in ten or more years, the value of the plastic pallet as a recyclable commodity is greater than the original cost of the plastic pallet resin material. The long term operating costs of a wood pallet are therefore higher due to ongoing maintenance costs than the original cost of the long lasting plastic pallet, so that the original lower price advantage of wood is lost to plastic. Thus plastic pallets are expected to gain a greater share of the 48×40 inch wood pallet market in North America.

Many proposed plastic pallet designs and structures measuring 48×40 inches have been offered to replace pooled 48×40 inch wood pallets. However, with the passage of time, it has been discovered that plastic pallets are also prone to wear and tear, presented by the effects of delamination, punctures, cracks and the like. These problems are not presented in wood, so plastic pallets have unique problems only recently realized. The prior art plastic pallets have not fulfilled the promise of a maintenance free pallet. Thus the price advantage of plastic pallets over the long run is lost. Consequently, wood remains the dominant material in the market to this day.

The iGPS pallet rented by iGPS Company, L.L.C. headquartered in Orlando, Fla. is the most widely used pooled plastic pallet in North America. The iGPS pallet is disclosed in U.S. Pat. Nos. D544175, 7,779,763 and 7,841,281 to Valentinsson, which are incorporated herein by reference. The so-called second generation iGPS pallet with vent holes in the upper deck surface is intended to provide a number of advantages to shippers who intend to replace traditional wood pallets with the iGPS pallet. This plastic pallet is supposedly superior to a wood pallet because it allows for tracking technology to be built into the pallet; is lower weight which saves on shipping costs and workplace injuries; is more durable, eliminating inherent wood repair and maintenance; has greater uniformity, reducing customer equipment and product damage; has reduced bacteria, mold and insect infestation; and is less flammable and has superior environmental sustainability.

Although prior art plastic pallets are an improvement over traditional pooled wood pallets, they suffer from many unique problems that are not encountered by pooled wood pallets.

The Valentinsson pallet is constructed from a unique combination of a first twin sheet deck and a second injection molded base. The deck and base are separately manufactured using two different production facilities. The twin sheet deck is constructed from two high density polyethylene (HDPE) plastic sheets that are sequentially thermoformed against first and second mold surfaces and then pressed together under heat, vacuum and pressure between two molds. The unitary construction of the twin sheet deck is resilient and fusion at the mating surfaces is long lasting and essentially permanent. The injection molded base is an assembly that includes a first upper injection molded section and a second lower injection molded section. Five steel reinforcement bars and four RFID tags are positioned between the sections before the upper and lower sections are fused together to form the base in a secondary operation. The deck and base are subsequently fused together in a final assembly operation to produce an operational pallet.

As a pooled returnable asset, each such pallet is intended to survive at least 60-80 trips in a period of 10 years. A comparable pooled wood pallet with extensive repairs and maintenance may enjoy 70 trips in 20 years. However, these plastic pallets are not surviving their intended number of trips and are suffering catastrophic damage in use. A routine inspection of ten randomly picked well-used pallets reveals eight are defective. All of the displayed defects concern the injection molded base and the fusion of the base to the deck. The twin sheet decks display wear and tear but no catastrophic damage is evident. The most frequent defects show separation where the upper and lower injection molded sections of the injection molded base are the fused together around the 48×40 inch perimeter. Such delamination is a catastrophic problem because the interior of the injection molded structure is no longer sealed against penetrating liquids, chemicals, dirt, debris, bacteria, insects and the like. Secondly, the top section of the injection molded base demonstrates cracks which indicate the materials are affected by cold condition impacts. Cracks admit additional materials into the cavities of the pallet which accumulate and add weight and corrode the steel reinforcement bars or deteriorate the performance of the RFID tags placed in the legs of the base of the exemplary pallet structure. A third observation is that the nine leg structures of the injection molded base are delaminating from the deck around the perimeter of the leg receiving pocket structures in the lower sheet section. This lesser problem indicates the difficulty of permanently fusing together two dissimilar plastic materials used to create the Valentinsson pallet. In use the injection molded components of the so-called $2^{nd}$ gen-pallet suffer catastrophic damage which is difficult and expensive to repair, so that the operating expenses of the exemplary plastic pallet are actually costlier than the operating expenses of wood pallets.

A fourth observed wear and tear problem with all plastic pallets concerns fork lift, pallet jack and pallet moving equipment related pallet damage. In operation a fork lift operator impacts a plastic pallet structure supporting a 14,000-pound load on the ground with pointed fork tines. Because of misjudgement, the wall of the impacted plastic pallet will very likely be punctured or pierced on a direct hit or tear when grazed by the forks. Twin sheet and injection molded leg walls cannot recover from these forces under compression. If the pallet is idle and unloaded in storage, the equivalent inertial impact is typically sustainable because the pallet moves with impact. Therefore, fork impacts under load represent a significant wear and tear problem for any pallet because a fractured or pierced pallet admits liquids and materials into the interior of the pallet, which is unacceptable. A plastic pallet meant to weigh less than 50 pounds (tear weight) weighs 65 pounds in use, because the interior spaces of the pallet have accumulated water within its interior spaces which has frozen as a result of been stored outside. Consequently, the pallet is no longer suitable for future rental trips based upon an original equipment standard or specification.

There are other problems with prior art plastic pallets. For example, the impact damages displayed by the injection molded components of the base are aggravated by the fact that fire retardant additives are mixed with the HDPE resins used to construct the pallet in order to achieve a UL safety rating for flammability. These solid materials weaken the impact strength of the resins. Additionally, some of the materials in the fire retardant additives are restricted by state law and there is a general concern the halogenated and other pallet materials for fire resistance are a health and environment risk.

Prior art teaches a twin sheet pallet structure is demonstrably stronger, suffers less wear and tear and is lower cost than an equivalent injection molded structure using the same measure and type of resin materials. Many prior art plastic pallets are injection molded because despite twin sheet's superior performance in many areas, twin sheet thermoforming has an inherent weakness. Single walled pallet legs are crushed under industry proscribed loads (GMA Spec. 15). Twin sheets pallets must therefore have double walled legs for strength, which can only be formed by depressing the material on the load support surface of the pallet deck into the leg pockets to thereby reinforce the pallet legs. This is a fundamental problem because the leg pockets accumulate liquids and debris and besides the industry standards require a minimum of 85 percent deck coverage, where 100 percent is preferred (GMA Spec. 4).

In a 48×40 inch pallet with nine leg pockets, it is impossible to comply with the requirements of industry using a twin sheet pallet assembly with nine leg pockets. The Valentinsson pallet is innovative because it uses a deck that does not include depending leg structures, so that the advantage of twin sheet thermoforming can be put to use with an injection molded base structure that includes the necessary legs. It should be noted that the legs, blocks and other terms used in connection with the structures of a pallet are interchangeable in meaning. Numerous derivatives exist to describe the same essential structures that extend between the deck and the base to admit the entry of fork tines, pallet jacks and other pallet handling equipment. The required pallet admits pallet jacks, forks and equipment and provides 4-way access.

Another problem is that a typical pooled plastic pallet, intended to last +/− ten years, is not easily modified to accept new tracking technology equipment. For example, Valentinsson describes making a knife cut in a groove in the area of a block to open a window into the interior of the corner leg structures. After opening the window and exchanging the transponder, a foaming compound is used to seal the window protecting the replaced transponder. Another example of this procedure is described in FR patent 2697801 dated May 1994, and incorporated herein by reference. The problem with this approach is that the foaming compound is difficult to remove so it is impractical to replace the second transponder with a third transponder should this become necessary.

These and other problems have created the need for a new and stronger plastic pallet.

SUMMARY OF THE INVENTION

In accordance with the present invention there is provided a pallet having a plastic deck with four sides between a top surface and a bottom surface and a plastic base. The deck and base are spaced apart by opposed block structures integral with the deck and integral with the base. The block structures are inset from the four sides and extend between the deck and the base with open spaces between block structures to allow for entry of fork tines, pallet jacks, and pallet moving equipment. The block structures have at their ends fastening elements for joining the deck to the base. Plastic impact guards surround the block structures for preventing the fork tines, pallet jacks, and pallet moving equipment from piercing a wall of the block structures. The impact guards have exterior surfaces offset from the inside block structures to form a continuous outer wall extending between the deck and base at four corners.

Further in accordance with the present invention there is provided a pallet having a plastic deck spaced apart from a plastic base by opposed inset block structures integral with the plastic deck and the plastic base. The block structures extend between the plastic deck and the plastic base and define open spaces therebetween to allow entry of fork tines, pallet jacks, and pallet moving equipment. The block structures have a double wall construction including a first exterior wall and a second interior wall. Plastic impact guards surround the block structures and prevent the fork tines, pallet jacks, and pallet moving equipment from piercing the exterior wall of the block structures to thereby prevent entry of foreign material into an interior space between the first exterior wall and the second interior wall.

Additionally, the present invention is directed to a pallet having a plastic deck spaced apart from a plastic base by opposed insert block structures integral with the plastic deck and the plastic base. The inset block structures extend between the deck and the base and define open spaces to allow entry of fork tines, pallet jacks, and pallet moving equipment between the plastic deck and the plastic base. The block structures have at their respective ends fastening elements for affixing the plastic deck together with the plastic base. At least one of the plastic deck and the plastic base includes a compartment extending into an interior space of a block structure. Plastic impact guards surround the block structures and prevent the fork tines, pallet jacks, and pallet moving equipment from piercing a wall of the compartment to thereby create an opening allowing entry of foreign material into the interior space.

A first object is to overcome the inherent problem of twin sheet thermoforming by using triple sheet thermoforming. Triple sheet thermoforming is used to provide a double walled leg structure while providing a load bearing surface with close to 100 percent deck coverage. This is achieved using three sheet of plastic. A top sheet forms a load support surface. A lower sheet forms the underside of the load support surface and a plurality of block structures. A middle sheet includes alternating ribs connected to the top sheet and the bottom sheet, to thereby maintain the top and bottom a fixed distance apart, plus a plurality of sections that extend into the block structures to thereby provide reinforcement with a double walled block structure.

The second object is to replace injection molded components with a thermoformed components. A triple sheet thermoformed structure is provided to replace the injection molded structure of two plastic parts. The second objective also eliminates the reliance upon comparably heavy steel reinforcement bars contained in the prior art pallets to meet the stringent 2,800 pound dynamic load criteria under racking conditions of the marketplace and GMA Standards. Substituting +/− seven (7) pounds of steel with up to seven (7) pounds of engineered HDPE resins in the triple sheet structure is described.

A third object is to utilize multi-layer sheet products in the construction of the triple sheet deck and base of the invented pallet structure. The injection molded base of the prior art pallet, which suffers the greatest wear and tear, is composed of two single layered material sections having additives that impact physical properties. In other words, with injection molding the finished parts are monolithic and in the case of fire resistant structures, the fire retardant additives are dispersed throughout the injection molded component. In a multi-layer twin or triple sheet structure only the exposed surface layer includes sufficient fire resistant additives to meet industry standards, while the substrate layer can include "high elongation at break" extrusion grade polyethylene resin compositions. The two substrate materials cross link to form a uniform bond. Multi-layer sheets are typically co-extruded. Multi-layered sheet used in the thermoforming process is more productive than mono-layered structures used in the injection molding process.

A fourth object is to provide a mechanical snap together deck and base pallet assembly, so that the problem of fusing two dissimilar material parts is eliminated. A snap together arrangement that requires more than 2,800 pounds of separation force to completely separate the deck and base is provided to insure a robust assembly.

A fifth object is to provide "impact guards" around the nine legs of the invented 48×40 inch block pallet configuration. Fork impacts cannot be avoided. The impact guards absorb fork impacts. Impact guards are damaged before the underlying block structures are damaged. If a wall of the block structure is pierced or otherwise compromised to admit liquids, chemical, bacteria and the like into the interior of the deck or base structures of the pallet through the feet or blocks, the pallet will no longer be suitable for its intended use. The impact guard is not necessarily involved in the mechanical assembly of the pallet, so that if the impact guard is damaged or misplaced while in circulation its loss will not affect the integrity of the assembly of the pallet deck and base. The impact guards at the four corners form the 48×40 inch boundary of the pallet between the deck and the base. The impact guards are offset from the block structures and fill the void created by the inset block structures so that at the corner the impact guards provide the vertical pallet wall that is easily manipulated at the wheel bends in pallet conveyer systems. If the impact guards included intents at the corners the pallet could cause the conveyer to malfunction.

A sixth object involves replaceable impact guards, so that from time to time the pallet can be repaired or upgraded by replacement of the impact guards. The individual impact guards can be branded, labeled, stenciled, printed or modified for practical purposes used in a described pallet management system.

A seventh object is to integrate at least one compartment into each of the deck and base of the new pallet for the safekeeping of electronic pallet tracking equipment. A molded compartment with a removable cover is more practical than cutting into the prior art pallet structures to remove or replace a transponder. The transponder positioned inside the Valentinsson pallet is described in more detail in U.S. Pat. Nos. 7,948,384 and 8,228,201 assigned to The Kennedy Group, headquartered in Willoughby, Ohio. These patents are hereby incorporated in their entirety by reference. The pallet compartments are configured to receive a respective cover to enclose an open space defining an interior within the pallet for transponders and the like in both of the deck and base. In the prior art pallet accommodating other electronics besides the original transponder is an afterthought, and does not recognize that multi-mode radio frequency devices are required to communicate within different wireless networks scattered throughout the FMCG industry supply chains. The compartment interiors are adapted to receive transponders and other electronic equipment used to monitor, record, communicate and manage the pallet for distribution purposes.

An eighth object realizes an engineered compartment cover. The cover includes features that require a special tool to remove the cover from the pallet, essentially rendering the cover permanent. The cover also optionally includes antenna means to conduct on-pallet inventory investigations. The lid has a larger footprint on the pallet surface than the underlying compartments for housing the electronics, for example in the foot well. A larger diameter cover can incorporate a large pallet antenna for sending and receiving radio frequency signals from article transponder devices on products supported on or adjacent to the pallet. The cover can be changed as industry migrates to new RF standards over the life of the pallet, without necessarily modifying the pallet assembly itself.

A ninth object is to meet all nineteen GMA industry specifications for pallet performance.

A tenth object is to use fire retardant materials and co-ex structures to provide non-hazardous solutions. Only a thin exterior layer includes the fire retardant ingredients, realizing a lower cost and lighter weight structure having superior physical properties. A thicker underlying layer of composite HDPE is provided. PP and bio-based resins are an alternative to polyethylene.

An eleventh object eliminates the vent holes patterned on the top side of the pallet for evacuating gases accumulating in underside network of ribs on the bottom of the pallet. A lower surface area is achieved with a flat surface. More area provides more material to support a flame. The strengthening rib structure in the present pallet is positioned inside and between the structure formed by the essentially flat top and bottom sheets. A substantial surface area between the nine leg structures is practically flat having minimum surface area to thus reduce the material exposed to fire in earlier pallet designs. Less surface area is preferred.

Another object of the present invention is to provide a pallet that can be used to change the regulations for idle pallet storage, allowing the pallet to be stored inside. The basis for change is safety. A pallet with an ability to sense a fire and send an emergency signal improves the overall safety inside the building. A position determination can be made to locate the safety risk, using battery powered pallet tracking equipment. Indoor storage will also result in lower pallet theft and wear and tear.

Another object of the present invention is to provide a 48×40 pallet foot print with a space between the top of the deck and the bottom of the base being a distance of 5 to 7 inches, with 6 inches or less being preferred. At the corners, the impact guards fill in a space provided by the inset block structures between the deck and the base so that corners of the pallet are right angles. The edge of the corner formed by the pallet outline formed by the deck, base and impact guards may be radiused from top to bottom.

Finally, sophisticated electronics inside each pallet include space for memory, which can include a shipper's proprietary data. Loss of data because of outdoor pallet storage is to be restricted by amendment to the regulations in future safety standards.

The foregoing and other features and advantages of the present invention will be more readily appreciated as the same become better understood from the following detailed description when taken in conjunction with the accompanying drawings and appended claims.

DESCRIPTION OF THE PREFERRED EMBODIMENTS

Figure 1:
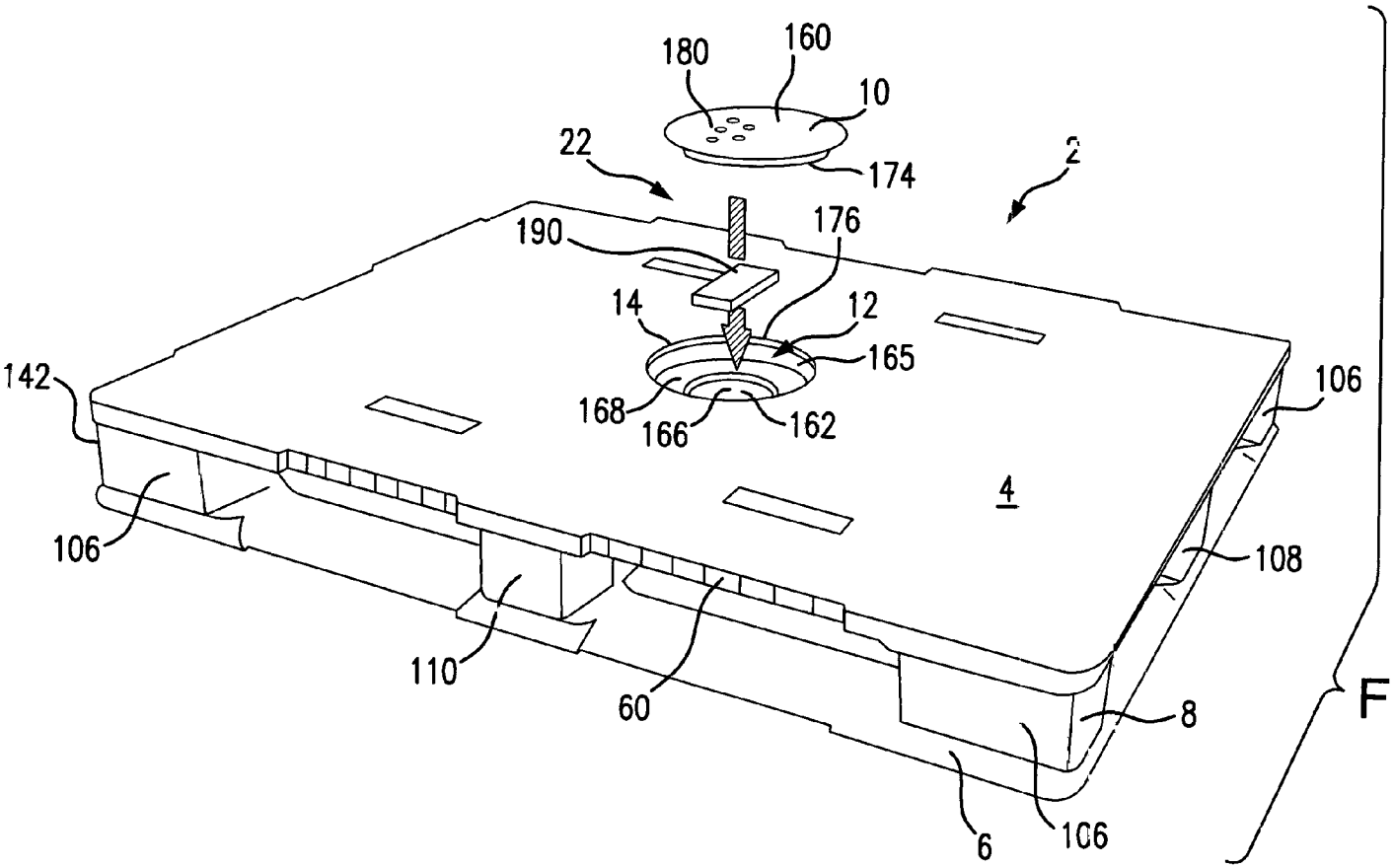
FIG. 1 is an exploded perspective view of a pallet with a cover removed from a compartment on the deck, showing a pallet tracking device in phantom inside the pallet.
Figure 5:
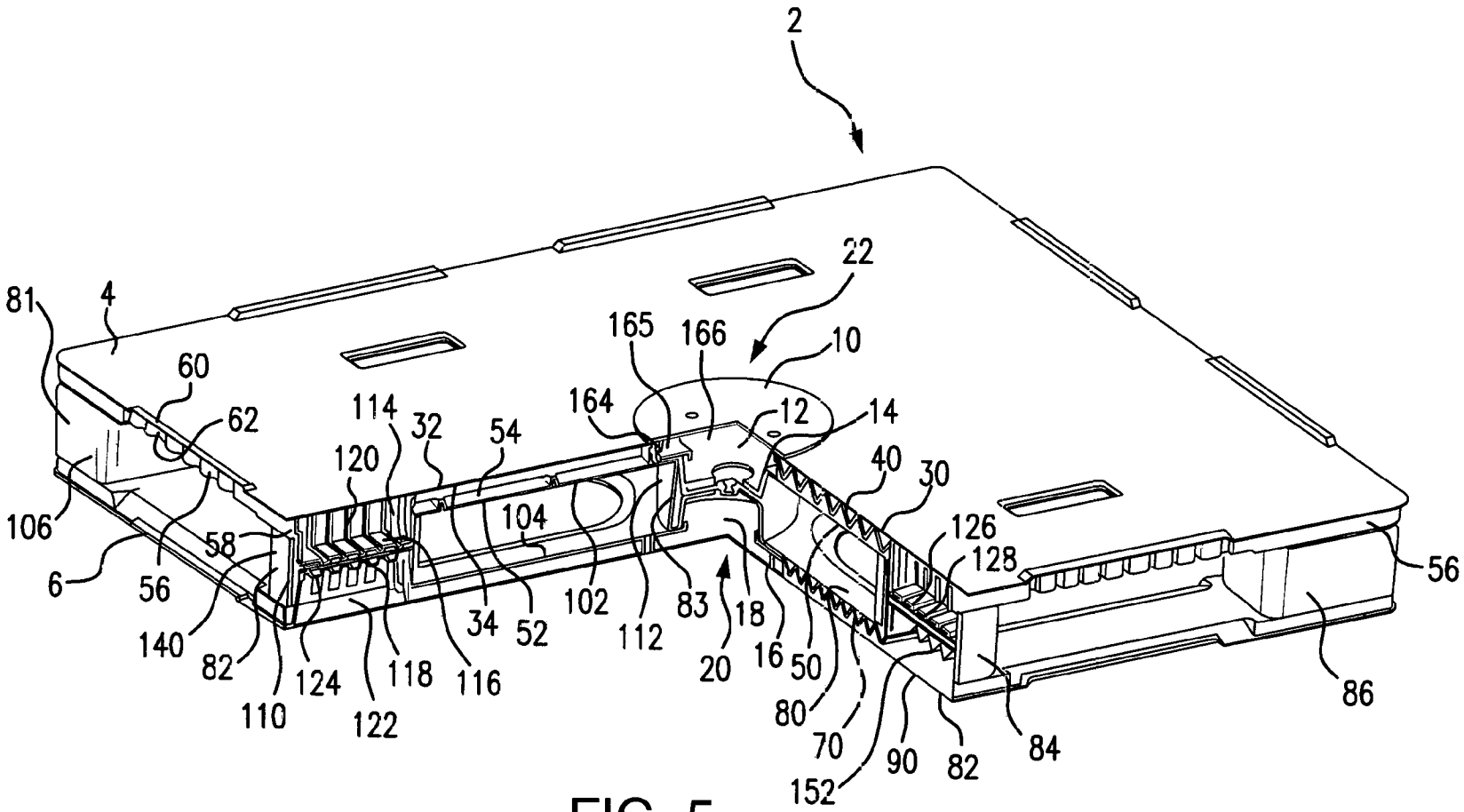
FIG. 5 is a cross sectional perspective view of the structure cut in cross-section from the center point in 24×20 inch direction, showing three quarters of the pallet.
Figure 6:
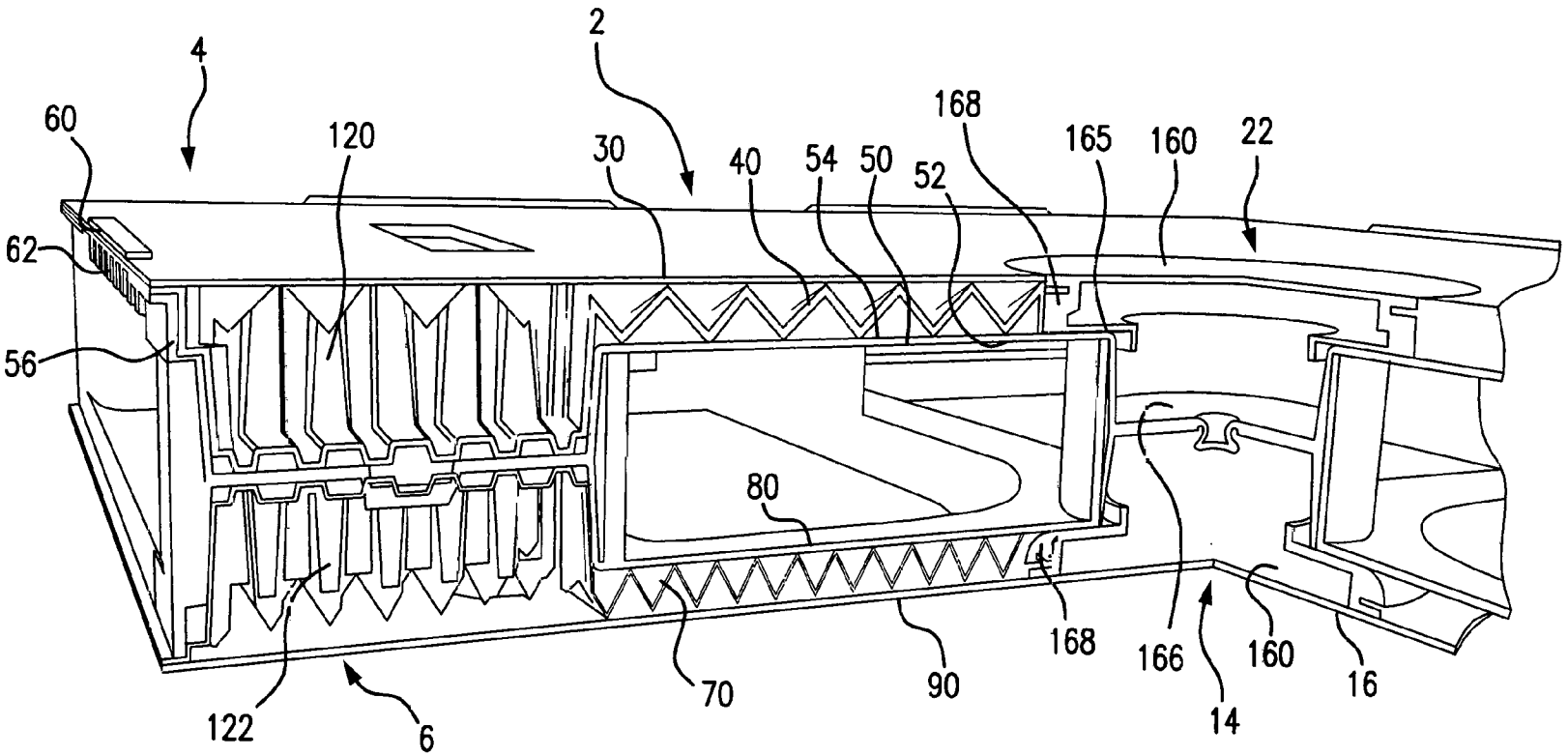
FIG. 6 is an enlarged fragmentary, cross sectional perspective view of the pallet shown in FIG. 5.

Referring to the drawings and particularly to FIGS. 1, 5, and 6, there is illustrated a pallet generally designated by the numeral 2. The pallet 2 includes a deck 4, a base 6 and nine impact resistant foot guards 8. Also shown is a first removable cover 10 for a first compartment 12 located within a center foot structure 14 of the deck. As shown in FIG. 5, a second removable cover 16 is provided for a second compartment 18 located with a center foot structure 20 of the base described. It should be appreciated that the position for the compartments and covers are not limited to the center foot assembly 22 of the pallet. The pallet comprises thirteen parts that are assembled into the pallet illustrated in FIG. 1. The pallet is a 48×40 inch rackable pallet, although many different pallet footprints, sizes and shapes are contemplated for pallets.

The Deck

As illustrated in FIG. 5 deck 4 is made from three sheets 30, 40 and 50 of thermoplastic material that are thermoformed according to the triple sheet method. Each sheet is engineered to meet specific performance criteria. The top sheet 30 is a co-extruded product comprising an application surface layer 32 and a substrate layer 34. The application surface layer 32 is composed of polyethylene materials having a density in the range 0.870-0.970 g/cm$^{3,}$ and intumescent fire retardant materials that are heavier, costlier and essentially halogen free. The percentage of intumescent materials in the surface layer is sufficient to provide a peak heat release rate of less than 500 kWm$^2$ as measured by the ASTM E1354 cone calorimeter method. The substrate layer is composed of high density polyethylene having a density in the range of 0.940-0.970 g/cm$^3$.

A middle sheet 40 of the deck 4 is preferably a co-extruded product, however the predominant constituent of the sheet is composed of high density polyethylene and optionally and preferably includes one or more reinforcing agents, fibers or fillers to increase the flexural strength of the molded part. Excluded from the list are long strand fibers and other nanocomposite materials that reflect radio frequency signals thus inhibiting the communications between the pallet and external network devices. The non reflective reinforcement additives can be orientated along the 48 inch or 40 inch direction of the pallet, or a combination of both with co-extrusion in mind.

The bottom sheet 50 of the deck 4 is a co-extruded product as well. The bottom sheet 50 is similar in construction to the top sheet 30, and includes a second application layer 52 and a second substrate layer 54. However, the percentage of intumescent materials in the bottom sheet 50 can optionally compose a greater amount of intumescent materials in order to achieve the desired peak heat release rate given the physical properties of the pallet structure. The principle of variable concentrations of fire retardant materials in a physical pallet structure are outlined in U.S. Pat. Nos. 6,807,910, 8,091,487 and 8,210,108 owned by Rehrig Pacific Company of Los Angeles, Calif. and are incorporated herein by reference.

The middle sheet 40 and bottom sheet 50 are also preferably thicker in cross section in comparison to the top sheet 30. The bottom sheet 50 is optionally thicker than the top sheet because the bottom sheet is subject to greater wear and tear and the increased thickness of the bottom sheet mitigates against impact damage commonly sustained by prior art pallets. The middle sheet 40 is also optionally thicker than the top sheet because the middle sheet 30 is responsible for providing the pallet with its dynamic and static load bearing strength.

The distance between the top surface at 32 and the bottom surface of the deck at 52 is in the range of 0.75 to 1.5 inches, with 1 inch preferred. In any case the middle sheet 40 extends between the inside surface 34 of the top sheet 30 and the inside surface 54 of the bottom sheet 50 in a reinforcing geometry to form a bonded hybrid honeycomb-like structure that resists bending. Any number of shapes or combination of shapes fall within the scope of the hybrid honeycomb-like structure, and, for example, include parallel ribs, intersecting ribs and round cones, six sided cones just to name a few. A saw-tooth configuration is used in the drawing figures for illustrative purposes only and these extend along the 48 inch direction of the pallet.

Figure 2:
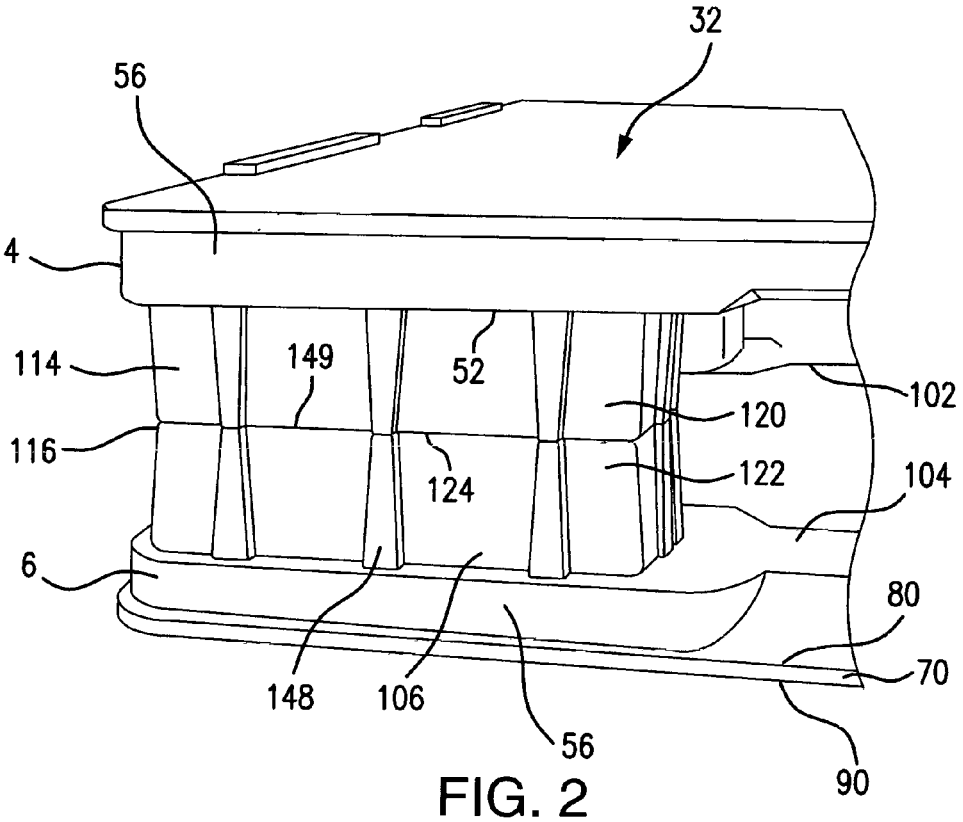
FIG. 2 is a fragmentary perspective view of the corner leg structure of the deck and base.

The four outer walls 56 of the deck as best seen in FIG. 2 are substantially vertical between the top surface 32 and the bottom surface 52, given the molding principles of thermoforming, which may involve a draft angle of 1 to 5 degrees. The bottom sheet 50 in a preferred design forms the exterior physical outer walls 56 of the deck. As shown in FIG. 5, the outer walls 56 include side by side indents 60 above fork lift openings which increase the surface area for contacting surfaces 62 that form the triple sheet bond in the thermoforming process.

The top sheet 30 and bottom sheet 50 prevent the middle sheet 40 from moving or spreading apart under load. This is one advantage of triple sheet over twin sheet thermoforming. The top sheet 30 prevents ribs in the middle sheet 40 from bending apart responsive to force from the bottom (such as by fork tines lifting the pallet) while the bottom sheet 50 prevents the ribs in the middle sheet 40 from bending apart responsive to force from the top (such as a heavy unit load on a warehouse rack). Supporting a unit load in a racking condition is preferred so the bottom sheet 50 is advantageously thicker than the top sheet 30 in the deck structure.

The Base

The base 6 shown in FIGS. 1, 2, 5 and 6 is also made from three sheets 70, 80 and 90 of thermoplastic material that are thermoformed according to the triple sheet method, although like the deck 4, a twin sheet structure is suitable. Again each sheet is engineered to meet specific performance criteria, like the deck. However, in the base structure the middle sheet 70 is thinner in cross-section than the top sheet 80 and bottom sheet 90. The middle sheet 70 of the base is consistent in composition and structure to the middle sheet 40 of the deck 4 and is not otherwise restricted to the description in this disclosure.

The composition and structure of the top sheet 80 of the base 6 corresponds to the composition and structure of the bottom sheet 50 of the deck structure. The composition and structure of the bottom sheet 90 of the base 6 is like the top sheet 30 of the deck, except the bottom sheet 90 is thicker to mitigate against abrasions eroding the application surface 92.

The pallet 2 can be strengthened with the addition of reinforcements to increase its load bearing strengths. Reinforcements include cross-members, material additives and material gauge changes. The reinforcements can be incorporated into the deck 4 and or the base 6 or both. However, the preferred mass of the pallet is 50 pounds or less, to meet GMA Spec. 14.

The Block Structures

Turning now to FIG. 2, The deck 4 and base 6 include nine opposing leg or block structures to support the deck 4 and base 6 a fixed distance apart for admitting fork tines, pallet jacks, pallet handling equipment and the like. The distance between the top of the deck 4 and the bottom on the base 6 ranges between 4.5 and 6.5 inches for a 48×40 inch pallet, although additional distances are contemplated for other pallet configurations.

The nine opposing leg structures provide between 3 to 4 inches of clearance between the bottom 102 of the deck 4 and the top 104 of the base 6, in order to comply with GMA Spec. 3. The sizes of the legs vary, given the physical specifications of the intended pallet. In the case of the exemplary 48×40 pallet of FIG. 1, there are four corner legs 106 measuring in the range of 9×5.5 inches, two middle legs 108 in the 40 inch direction measuring in the range of 9×5.5 inches, two middle legs 110 in the 48 inch direction measuring in the range of 5.5×5.5 inches and one center leg 112 measuring 6×6 inches or less. The legs can be round, oblong, rectangular or square, and have radiused corners where applicable. The walls 114 shown in FIG. 2 of the legs or opposed block structures are substantially vertical between the deck 4 and the base 6, although angled and stepped walls are contemplated. The four walls 114 or continuous wall of the each leg or block structure is integral with the deck 4 and the base 6 in a preferred embodiment, and terminate in a closed end that forms a surface 116 that can be flat and parallel to the top of the deck 4 or parallel to the bottom of the base 6. Optionally, the walls 114 can include a stepped or angled configuration such that the walls do not extend the same distance on four sides.

As shown in FIG. 2, exemplary deck 4 includes nine depending leg structures 120 and the base 6 includes nine extending leg structures 122. The depending and extending leg structures project equal distances to meet in the middle 124 between the deck 4 and the base 6. Alternatively, the leg structures 120 and 122 meet at any position defining a fork opening between the bottom of the deck 102 and the top of the base 104. The legs or block structures can extend in either direction by different lengths so that the interface between the surfaces of the opposed surfaces is variable. The deck legs can extend one (1) inch and the base legs can extend three (3) inches, or visa versa, for example.

Figure 4:
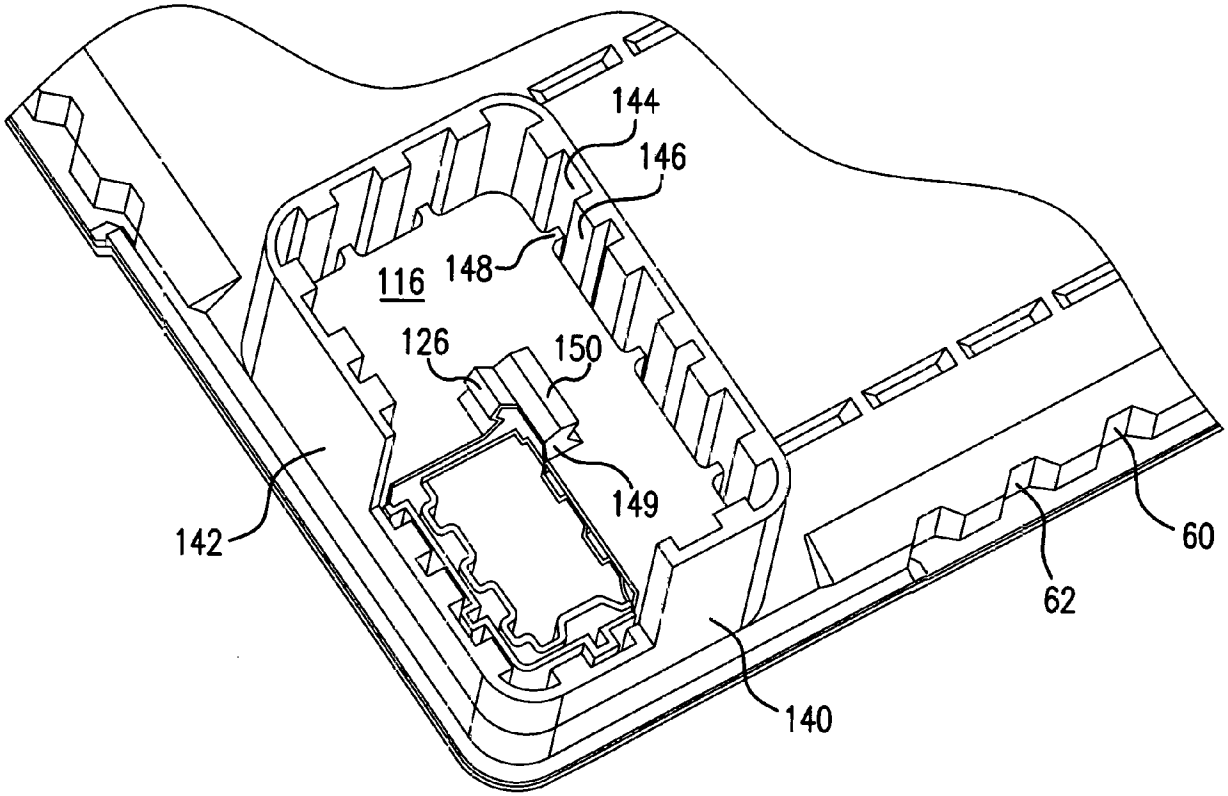
FIG. 4 is a fragmentary perspective view of the bottom of the deck structure taken at the corner, showing a partial cutaway to illustrate the features of the deck structure having a double-walled legs and a corner impact guard.

The nine opposing leg structures 120 and 122 of the deck 4 and the base 6 form surfaces 118 shown in FIG. 4 that provide a snap-together assembly of the deck 4 and the base 6. The surfaces of the opposed legs include male structures 126 and female structures 128 whereby the deck 4 and the base 6 are assembled by a press fit. The male structures can be incorporated into the deck 4 or the base 6 and female structures can be incorporated into the base 6 or the deck 4. The snap design features can be incorporated about each perimeter of the flat surfaces 116 (FIG. 2) or be positioned inside the perimeter. One or more snap-together features can be established between each one of the nine juxtaposed legs, so there are double snap fit aspects with each of one or more legs.

The snap together arrangement is preferably configured to prevent horizontal and vertical separation of the deck from the base under 14,000 lbs. of distributed weight, and 2,800 lbs. at any leg structure under such use. Disassembly of the pallet is facilitated with a carver press, whereby platens are forced apart to separate the deck and base. After the deck and base are separated, new deck and base combinations are possible by simply replacing the old deck or base for a new deck or base.

The Impact Guards

Figure 3:
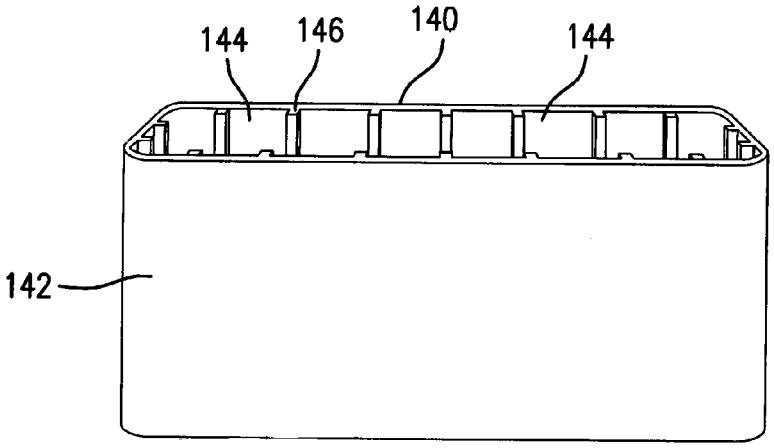
FIG. 3 is a perspective view of an impact guard for the corner leg.

Nine impact guards 140, as shown in FIGS. 3 and 4, protect the nine leg or block structures of the pallet from fork impacts and the like. The impact guards extend between the bottom of the deck 4 and the top of the base 6 in the exemplary figures. In another embodiment, they extend from the top of the deck 4 to the bottom of the base 6, or in other different combinations that prevent the deck 4 or base 6 from being damaged so that foreign materials are not admitted into an interior space of the deck 4, base 6, block structure or compartment of the pallet assembly.

The impact guards 140 in the exemplary pallet are not required to assemble the deck 4 to base 6, although it is recognized the impact guard can include features required to assemble the deck to the base. It is also an option to physically connect the impact guard 140 to one or both of the deck 4 and the base 6 during the thermoforming process, so the impact guard forms a part of the deck or base or both.

Each impact guard 140 is preferably removable so that a damaged impact guard is replaceable, if it is damaged or needs to be replaced for pallet management purposes. In this event, the impact guard 140 is one or multiple pieces that allow the damaged impact guard to be removed and replaced altogether or in pieces. In another embodiment, impact guard 140 is hinged at one end and clasped together at another end to allow it to be removed and replaced while the pallet is assembled. In another arrangement, the deck 4 and the base 6 are separated, allowing the damaged impact guard 140 to be lifted away from a block structure and subsequently replaced.

Different impact guards 140 are provided for different working applications. For example, material formulations for cold chain distribution networks are tailored for cold temperature operating conditions. For example, cold conditions impact guards are constructed from a polyethylene, polypropylene or bioplastic formulation that is lower density and having longer molecular chains. The impact guards are also adapted to display user signage and machine readable information.

Preferably the impact guard is fabricated of any resilient plastic material that absorbs fork tine impacts, exhibits a PHRR of less than 500 $kWm^2$, and is effectively transparent to RF signals (this means a lower dialectic constant). As shown in FIG. 3, impact guard 140 includes an outer physical surface 142 and an inner physical surface 144. The inner surface 144 includes impact ribs 146 of increased thickness. The impact ribs inter-engage with exterior leg ribs 148 formed in the block structures of the deck 4 and base 6. This arrangement prevents shifting of the impact guard relative to the outer walls of the deck 4 and base 6 as best seen by the outer boundary in FIG. 2. The impact guards 140 can be fabricated of different sizes and shapes corresponding to the shapes and sizes of the legs and block structures. In one method of fabrication, the impact guards 140 are extruded, thermoformed or injection molded, depending upon the preferences of the practitioner.

The Compartment Covers

The deck 4 and base 6 of the pallet include compartments 162 shown in FIG. 1 for electronic devices. Each compartment is closed with a cover 160. The cover 160 closes the compartment 162 by various means with the understanding that the cover 160 requires a special tool or process to remove the cover, so the electronic devices are secured within the compartment 162. The cover 160 also forms a part of the load bearing surface of the deck 4 or the load supporting surface of the base 6. The cover 160 can be round or a different shape.

The cover 160 optionally includes an o-ring 164 or the like to effect a water-tight compartment seal. The cover 160 can also include components of the electronic equipment. For example, a radio frequency transmitting and receiving antenna 180 is integrated into the structure of a cover that is configured to provide an interrogation read range or envelope corresponding to a unit load positioned on the deck. The unit load can change in size for each pallet rental trip so the antenna is multipurpose operating on different radio frequencies using different air interface protocols, having different power levels and using a microprocessor to manage the pallet based upon computer implemented strategies resident in the Cloud or other networks or in the processor within the compartment. In another embodiment, the cover 160 is also configured to disable the electronic equipment when it is removed or partially removed from the new pallet.

The Compartment Bushings

As shown in FIG. 6, each compartment 162 includes structures for affixing the cover to enclose and seal the pallet tracker within the pallet. In the present embodiment a bushing 168 is alternately integrated into the deck 4 and the base 6 and the bushing allows the intended cover 160 to be assembled with the deck 4 and base 6 of the pallet. The structure of the bushing 168 is integrated into the deck 4 and the base 6. In the present embodiment the bushing 168 is an injection molded component with a thread pattern positioned on an interior annular boundary inside the opening of the bushing. The bushing 168 is positioned within or upon the deck 4 or the base 6 and arranged to receive the cover 160 having an extended threaded portion, allowing the cover to be turned, rotated, screwed or otherwise positioned with the bushing to effect a water-tight seal.

In one embodiment, the bushing 168 is integrated into the structure of the deck 4 and the base 6 utilizing triple sheet insert molding techniques. Although threaded details have been described, other snap-fit and fastening configurations are possible within the scope of options available using triple sheet thermoforming.

The deck 4, base 6, impact guards 140, bushings 168 and covers 160 comprise the major plastic components of the pallet.

The leg pocket and block structures are shown in detail in FIGS. 2 and 3. A corner leg pocket structure, seen from the 40 inch side is illustrated in FIG. 2. The near vertical walls 114 of the nine opposed leg or opposed block structures are inset from the outer walls 56 of the deck 4 and the base 6 to accommodate the impact guards 140, which form the outer boundaries of the pallet 2. The outer surfaces 142 of the impact guards 140 shown in FIG. 4 form the outer dimensions defined by a 48×40 inch pallet. The ribs of the inner surfaces of the impact guards 140 include strengthening features 146 that also register with the outer surfaces 148 of the vertical walls of the downward extending and upward projecting block structures of the deck 4 and base 6. The near-vertical walls 114 of the leg structures are double walled such that if the impact guard is damaged and the outer surface of the leg structure is sliced open or pierced by a fork impact, the middle sheet forming the double walled leg is offset and somewhat protected against the full impact of a steel fork tine. In this manner the isolated double walled legs limit the intrusion of foreign debris to an isolated single walled cavity in the leg structure and not throughout the remaining pallet interior as in prior art twin sheet and injection molded pallet structures.

FIG. 4 shows one snap fit arrangement that is used to assemble the deck 4 to the base 6. Each leg structure includes four walls that terminate in a closed end 145. The closed ends form a matching surface 149 where the deck and base meet at the interface of the block structures. The matching surfaces 149 of the deck 4 and the base 6, at each particular block structure of the pallet, include features for establishing a snap-fit connection. For example, without limitation the surface of the leg structure of the deck includes a male projection 150 for receipt in a female recess 152 of the top surface of the leg structure of the base. The projection 150 engages with the recess 152 for a mechanical assembly. The arrangement can be rotated in the opposite direction so that the female recess 152 is associated with the base 6 and the male projection 150 is associated with the deck 4. There may be a plurality of reciprocal snap-fit features on each pair of legs forming the individual block structures.

The snap fit features are preferably molded into the thermoformed parts, however snap fit mechanical components can be substituted. In one embodiment, the components are loose pieces that are mechanically or press-fit attached to the deck or the base to allow the deck and base to be assembled.

The compartments 162 in FIG. 5 are substantially the same depth, however it is recognized one or more legs from the deck 4 or the base 6 can extend or project a further distance so that the size or depth of the compartment is increased or decreased to accommodate larger or smaller electronic equipment and/or power resources. In one embodiment as shown in FIGS. 5 and 6, the deck compartment comprises two levels. The first level 165 formed between the deck's top surface and the deck bottom surface has a greater diameter or opening area than the second level 166 which extends into the foot or remaining interior space, and is limited in size by the dimensions of the interior wall of the block structure. The first level 165 accommodates an electronic component that is greater in size than the dimensions formed by the second level foot well 166.

The cover 10 in FIG. 1 includes in one embodiment one or more antenna 180, electrical connectors, and or machine readable components 172 positioned on a surface. The added components can be positioned exteriorly and interiorly. Preferably the cover 10 is monolithic or an assembly of parts made of any resilient plastic or bioplastic material that absorbs fork tine impacts, exhibits a PHRR of less than 500 $kWm^2$, and is effectively transparent to RF signals. More than one cover 10 may be provided in different sizes, shapes and configurations. In the embodiment illustrated in FIG. 1, the cover 10 includes a threaded portion 174 that screws into a threaded opening 176 of the compartment. The threaded opening 176 may be formed by a molded bushing 178 that is integrated into the deck or base structure. The bushing 178 may have multiple threaded aspects. In another arrangement a press fit or snap fit or mechanical fastening is used to secure the removable cover 10 to the compartment opening. The function of the cover 10 is to secure the electronic components within the compartment 12, so as to prevent unauthorized tampering and to protect the electronics against liquids, solids, pathogens, insects and the like from entering the compartment 12. The covers also increase the load support surfaces of the deck 4 and base 6.

As shown in FIG. 1, one example of a cover 10 a machine readable component is an antenna array 180. The array 180 is configured to interrogate the radio tags on items or packaging placed and other pallets on the assembled pallet. The array 180 includes multi-frequency antenna so that different radio tags operating on different radio frequencies can be queried. The antennas are integrated in the cover material or positioned upon an exterior or interior portion of the cover 10 that extends into the compartment 12. If different antenna arrays are required in order for the pallet to perform its inventory taking purposes using new radio frequencies and air interface standards, it is a simple matter to replace one or more of the covers to accommodate the new radio frequency bands.

In one embodiment the interiors of the compartments 12 can include steps, pockets, ribs and the like to position the electronic components so they do not move in use. Rivets, fasteners, adhesives, tapes and the like are used to secure circuit boards or hard shells to the interior surfaces of the pallet 2 and cover 10. The interiors of the compartments 12 are purposefully configured. For example, the compartment 12 in the base 6 includes a battery and power generation system while the compartment 12 in the deck 4 includes the suite of wireless electronic equipment with sensors to which the system is responsive. In another embodiment an electrical connector is provided at the interface between the stacked compartments when the pallet is assembled. The deck 4 and the base 6 are electrically connected when assembled for use. The connections are made at the interface of the respective ends of the opposed block structures extending between the deck 4 and base 6. For example only, one pallet part supplies power while the other pallet part supplies communications, sensors, data processing and data storage means. One or more electronic connectors are provided at the interface between the stacked or opposed block structures with the compartments when the pallet is assembled.

Connectors include, but are not limited to DB-type, Centronics, HD-type, USB, Modular, SCSI, DIN-type, Fiber, V-type, Coax & Twinax, IEEE, TUV, Utility and other miscellaneous electronic and power ports and connectors. These connectors are desirably weather, temperature, moisture, dust and impact resistant for withstanding the tough environmental and operating conditions within the material handling environment. The deck and the base are electrically connected when assembled for use. For example only, one pallet part can supply power while the other pallet part supplies communications, data processing and storage through the connectors and or electronic and power ports.

A pallet communications system is set forth.

The pallet communication system 190 shown in FIG. 1 includes a plurality of radio frequency transponder devices operating on different radio frequency bands including but not limited to 120-150 kHz, 13.56 MHz, 433 MHz, 860-960 MHz and 2.45-5.8 GHz. Other less common radio frequency bands or proprietary operating environments are not excluded as the compartments 12 are easily retrofitted with new equipment. In one embodiment, a transponder device is individually self contained or added to a multi-purpose circuit board. In another embodiment, the transponder device is integrated on a common or second substrate or circuit board through a bus architecture with one or more microprocessors. Microprocessors are capable of receiving a data communication on a first radio frequency band and sending a data communication on a second, third or fourth radio frequency band or using another air interface protocol. In a further embodiment multiple transponder devices are provided to operate on similar RF bands but using different air interface protocols. A plurality of transponder devices provide versatility and wide scale interoperability.

In one embodiment of the present invention, the deck 4 includes a first communications system and the base 6 includes a second communications system. The first system includes a master pallet communications system having a first plurality of RF transponder The second system includes a slave pallet communication system having a second plurality or fewer number of RF transponders. The slave system optionally includes its own microprocessor and power supply. The systems in the deck 4 and the base 6 may form a local wireless network to which the system is responsive. The deck 4 is coupled with a new base, thus forming a new network. For example a new sensor in the base observes a fire and uses a 2.45 GHz 802.n air interface protocol (such as but not limited to Bluetooth™ or Zigbee™) to communicate sensor indicative data a short distance to a transponder device in the deck connected to a second microprocessor. Optionally, the 2.45-5.8 GHz transponder sends an alert in the case of a fire through a cellular network to a remote pallet management server connected to a Cloud or proprietary network. The cellular or WiFi communication signal includes in one embodiment data triggering an action to which the system is responsive. The call center alerts the in-building fire suppression system to react and notify a local fire hall of the emergency.

The pallet communications system includes a plurality of sensors integrated with the microprocessors. Numerous types of sensors are contemplated for measuring different conditions relevant to pallet management, supply chain logistics and unit load security and integrity. In use, the microprocessor receives user defined pallet shipping criteria from the item RF tag or from a pallet management server through the RFID, WiFi or Cellular transponder device. In any case the microprocessor enables selected sensors for each pallet rental trip, in order to save battery power in one use case scenario. For example, when the 860-960 MHz transponder device acquires electronic information from an item on the pallet, such as frozen ice cream, the system is responsive to high temperature conditions. The microprocessor recognizes the shipping risk based upon rules in memory or provided and enables integrated temperature sensors for monitoring the cold chain conditions of the exemplary frozen product during the intended unit load trip, which is enabled as a valued added benefit. The user-defined criteria calls for a temperature reading in increments of minutes, hours, days and by a triggering event. The microprocessor is selectively responsive to sensor priorities to preserve battery power. For example, acceleration, light exposure or $CO^2$ concentrations are not sensor conditions that affect frozen ice cream, and so these and other sensors are placed into low or no power rest. Sensors are turned on and off, in order to preserve power, at will. The remaining or chosen sensors are enabled, on a user defined automatic electronic basis.

In the present example, the microprocessor causes an alert notification to be communicated to a monitoring station using the lowest power transponder device given protocol options for a circumstance in which temperature, or some other condition, that the pallet apparatus detects. For example, a reefer truck with a malfunctioning refrigeration unit could result in the spoilage of a shipment of ice cream. A sensor communicates with the microprocessor which in turn triggers an alert or enters an elevated status of reporting schedules. Immediate diversion to a cold storage facility to save the load from becoming a total loss or a possible threat of contamination in the food supply is implemented as a result of a pallet message received by the pallet management server. The microprocessor includes a memory device to record a time stamp and a record of observed sensed conditions and a buffer to accumulate the aggregated information. The buffer stores the indicative data and sends the stored data to the pallet management server on a schedule where the stored data is even made available to the third parties. The pallet management server erases the stored data in the buffer or in memory before the pallet is rented to another party.

The pallet communications system 190 requires a power resource in order for the pallet to perform its intended functions. Before the power resource expires the pallet must be recovered, which adds pallet management costs. If the power is depleted the result could be a lost pallet. A power management module is incorporated with the microprocessor. The objective of the module is to extend the life of the power resource in operation and to preserve enough power in order to effect the recovery of the pallet in all circumstances. Power management strategies are well known and some of these are disclosed by U.S. Pat. Nos. 8,254,868 and 8,258,748 to Enfora Inc. of Richardson Tex., and cited in their Prior Art Disclosures, all of which are hereby incorporated by reference.

Individual transponder devices within the pallet are capable of responding to RFID query signals, so the pallet will never be lost. For example, the pallet includes an EPC RFID transponder that wirelessly, uniquely individualizes each pallet within the EPC ecosphere. The pallet also includes a 13.56 MHz transponder for communicating within short ranges with factory automation equipment and NFC hand held devices (smart phones) and the like. These exemplary transponder devices do not need power, so that the pallet can still be identified and recovered if the power resources for the battery operated 125 kHz, 433 MHz and 2.45-5.8 GHz and other radio frequency bands included in the pallet apparatus are depleted.

Theft and loss of plastic pallets is a risk due to the plastic material's regrind value. The material of each pallet includes taggants or markers so that the material from the pallet can be identified within the market place for recycled materials. These identification devices are used to recover stolen reground pallet materials.

The battery resource includes a power generation system. The generated power is stored in a capacitor, spring, battery or directly powers a transponder means. For example, piezoelectric generators are furnished to capture energy from the movement of the pallet and a capacitor stores energy from ubiquitous radio frequency signals in the environment. Photovoltaic devices with transponder and sensor devices are contemplated for exteriorly exposed surfaces. A plurality of batteries are contemplated for use within the system.

If the pallet is used in cold storage at low temperatures, the battery is adapted to further power a small heat source. A microprocessor with a temperature sensor or the like elevates the temperature inside the compartment to within the operating limits of the RFID, WiFi and cellular components.

As noted earlier, idle pallets are typically stored outside. Typical wood pallets are stored outside because they pose a fire risk and are regulated by building standards and codes. Wood pallets are also stored outside until they have accumulated into a truck load quantity so they can be efficiently recovered by a pallet recycler. The 48×40 inch wood pallet logistics infrastructure, requiring +/−300 million pallets, is uneconomical because they are not freely circulated and remain out of service for long durations of idle storage.

The materials of the pallet of the present invention pose less fire risk than a wood pallet and includes a temperature sensor and a reporting device to send a first alert in the event of a fire or sensed emergency condition. Sprinkler systems in the immediate area of a fire can activate and safety protocols can be executed with the aide of the electronics inside the pallet. The exemplary pallet becomes a safety measure resulting in lower insurance costs.

Additionally, wood pallets do not have individual serial numbers or machine readable identifications so it is the responsibility of the pallet recycler to separate the different 48×40 inch wood pallets manually. For example, in a typical accumulated load of 400 pallets there may be 192 blue wood pallets, 40 red wood pallets, 20 black plastic pallets and 148 white wood pallets comprising "A" and "B" pallet cores. The recycler in turn accumulates the pallets from many locations until there are truck loads of blue, red and black pallets that are separately recovered by the pool operators directly or through third parties. The recycler receives a recovery fee from the pool operators of the blue, red and black pallets. The recycler than re-sells the remaining white wood pallet cores.

The existing 48×40 inch wood pallet recycling model is inefficient, and impractical for use in a managed pallet exchange system. The pallet tracking technology inside each pallet is capable of recognizing an exchange in custody of the pallet between supply chain partners when they occur in real time. The real time chain of custody allows the pool operator to accurately bill each customer for the physical use of the plastic pallet, user-defined access to the electronic equipment and power utilization. At the end of the billable trip user defined proprietary data and settings are transferred to the Cloud and erased at the pallet level. The pallet tracker is than placed into a low power status until triggering events cause the system to begin recording events indicative of a change in custody and a new rental trip. For example, a new rental trip is confirmed when the new shipper uses defined resources of the pallet. The uploaded data from the pallet tracking device is made available to the pallet user to meet regulatory compliance rules and to achieve internal sustainability goals.

Because of the very nature of the 48×40 inch wood pallet recycling business model wood pallets are only used for +/−3.5 trips a year. An average trip is 700 miles and typically lasts five (5) to twenty two (22) days. This means wood pallets are only used for 5 to 22 percent of the days in a year in the fast moving goods sectors. For example, an automotive supplier in St. Louis can send auto parts to Detroit in a JIT industrial framework and the pallets become idle in five days. Alternatively, a strawberry grower in Mexico can ship a reefer truck load to a Canadian 3$^{rd}$ party cold storage logistics supplier where the individual packages of strawberries are eventually distributed to grocery stores across regions of the country on the original shipping pallets. A strawberry has a shelf life, and at the end of the shelf life the pallet should be available for recirculation. In other words, a short rental trip is anticipated because the limited life of a perishable product. For fast moving consumer goods like detergent soaps, the goods can remain on a pallet for an extended dwell time because of the product's indefinite life. In both cases, wood pallets are recovered so then they can be repaired, while plastic pallets can be immediately re-let for another rental trip. Plastic pallets enjoy many more trips a year than a wood pallet which is withdrawn from service.

Today shippers use an invisible physical asset (wood pallets) to ship product to market. Shippers pay a small fee in the order of $6.00 to rent a wood pallet but have no insurance the product will not be lost, stolen, diverted, damaged, polluted or counterfeited or perish while it is on a 48×40 inch wood pallet within their supply chain. With the ubiquity of wireless technology, shippers should instead focus on insuring the goods reach their markets using pallet tracking technologies. A rejected load of ice cream in Dallas shipped from Boston could result in a loss of tens of thousands of dollars for the shipper. A multi-use pallet with a $15 temperature sensor could detect an elevation in temperature to which the system is responsive and send a message causing the diversion of the load at risk to the nearest cold chain storage facility, where the remaining life of the affected product can be effectively managed.

The cost of an alert signal using cellular M2M technology maybe two or three times the cost of a physical wood pallet rental fee of $5-8.00. The additional "wireless" costs to avert a loss could be $16 to $24 for a roaming cell phone call from a pallet to a shipper. The potential loss of all or a portion of a truck load of perishable products represents a considerable cost spread over many deliveries. These risk costs are higher than the amortization costs of a multi-purpose, multi-frequency smart pallet tracking devices that cost more than the pallet itself over tens if not hundreds of rental trips, the cost of a potential product loss and its regulatory repercussions is avoided with a use of the tracking technology.

The present pallet is individually identified by at least five machine readable devices. Wireless systems are ubiquitous so that the pallet will never be invisible. The migration of the pallet over ten years can be tracked and associated with a shipper on each leg of the journey.

If the pallet migrates beyond a recognized supply chain, the electronics can be used to pinpoint and report its location. An electronic pickup request is sent to FedEx, UPS or another shipping company. The pallet can be identified using a hand-held scanner or smart device and recovered from the remote location. The cost to recover the pallet would be paid by the last known pallet user or the pallet pool operator. The pallet rental service could also involve an insurance premium to spread the risk of lost pallets among many pallet users.

According to the provisions of the patent statutes, I have explained a preferred construction and mode of operation of my invention and have illustrated and described what I now consider to represent its best embodiments. However, it should be understood that within the scope of the appended claims, the invention may be practiced otherwise than as specifically illustrated and described.

I claim:

1. A pallet comprising:

a plastic deck having a top surface and a bottom surface with four sides and corners there between, a plastic base, said deck and base being supported by opposed block structures formed integral with said deck and said base, said block structures having at their opposed ends fastening elements for joining said deck to said base to define open spaces between said deck and said base, said block structures being inset from said four sides and extending between said deck and said base with open spaces between block structures to allow for the entry between said deck and said base of fork tines, pallet jacks and pallet moving equipment, plastic impact guards surrounding said block structures for preventing the fork tines, pallet jacks and pallet moving equipment from piercing a wall of said block structures, and said impact guards having exterior surfaces offset from inset block structures to form a continuous outer wall extending from the bottom surface of said deck to the top surface of said base at said four corners.

2. A pallet as set forth in claim 1 wherein, said plastic impact guards are removed from connection to said plastic deck and said plastic base.

3. A pallet as set forth in claim 1 wherein, said plastic impact guards are replaceable.

4. A pallet as set forth in claim 1 wherein, said plastic impact guards are 100% recyclable.

5. A pallet as set forth in claim 1 wherein, said plastic impact guards are composed of a composite polymeric material having a peak heat release rate of less than 500 kW/m$^2$.

6. A pallet as set forth in claim 1 wherein, said four sides of said plastic deck between said top and bottom surfaces are positioned adjacent said impact guards and form vertical walls.

7. A pallet as set forth in claim 1 wherein, said four sides are positioned adjacent said open spaces between said block structures and extend between said bottom surface of said deck and a top surface of said base.

8. A pallet as set forth in claim 7 wherein, said exterior surfaces of said plastic impact guards at said four corners reside on the same vertical plane as the four sides at said four corners of said plastic deck.

9. A pallet comprising:

a plastic deck spaced apart from a plastic base by opposed inset block structures formed integral with said plastic deck and said plastic base, said block structures having at their opposed ends fastening elements extending between said plastic deck and said plastic base for joining said deck to said base and defining open spaces therebetween to allow the entry of fork tines, pallet jacks and pallet moving equipment, said block structures having a double wall construction comprising a first exterior wall and a second interior wall, plastic impact guards surrounding said block structures and extending from the bottom surface of said deck to the top surface of said base to prevent shifting of said impact guards relative to said deck and said base, and said impact guards being fabricated of plastic material to prevent the tines, jacks and equipment from piercing said exterior wall of said block structures to thereby prevent entry of foreign material into an interior space between said first exterior wall and said second interior wall.

10. A pallet as set forth in claim 9 wherein, said exterior walls of said opposed block structures are spaced apart from said interior walls and said exterior and interior walls of said block structures are alternately double walled and single walled.

11. A pallet as set forth in claim 9 wherein, said plastic deck includes a continuous top surface and a continuous bottom surface between said block structures, and said top surface and said bottom surface are a fixed distance apart with said deck having a thickness between said top and bottom surfaces.

12. A pallet as set forth in claim 9 wherein, said block structures at their respective ends form male to female receiving ends for affixing said plastic deck to said plastic base.

13. A pallet as set forth in claim 12, said male to female ends hold said plastic deck and said plastic base together in use without the aid of said plastic impact guards.

14. A pallet as set forth in claim 9 wherein, said plastic deck includes a top surface and a bottom surface separated by four sides walls defining four corners, and said block structures being integral to said plastic deck and inset from said four side walls at said four corners.

15. A pallet as set forth in claim 14 wherein, said plastic impact guards positioned at said four corners have exterior surfaces off set from said inset block structures to form continuous corner side walls extending on the same vertical plane defined by said four side walls at said four corners of said plastic deck.

16. A pallet as set forth in claim 15 wherein, all four pallet corners from said top surface of plastic deck to said bottom surface of said plastic base are perpendicular when said impact guards are present.

17. A pallet comprising:

a plastic deck spaced apart from a plastic base by opposed inset block structures formed integral with said plastic deck and said plastic base, said inset block structures having at their opposed ends fastening elements extending between said deck and said base for joining said deck to said base and defining open spaces therebetween to allow the entry of fork tines, pallet jacks and pallet moving equipment between said plastic deck and said plastic base, at least one of said plastic deck and said plastic base includes a compartment extending into an interior space of a block structure, plastic impact guards surrounding said block structures and preventing the tines, jacks and equipment from piercing a wall of said compartment to allow entry of a foreign material into said interior space, and said impact guards extending from the bottom surface of said deck to the top surface of said base to prevent shifting of said impact guards relative to said deck and said base when contacted by fork tines, pallet jacks, and pallet moving equipment.

18. The pallet as set forth in claim 17 wherein a removable cover is provided to close said compartment.

19. A pallet as set forth in claim 17 wherein, said compartment is positioned on one of said top surface of said plastic deck and a bottom surface of said plastic base.

20. A pallet as set forth in claim 17 wherein, said plastic impact guards are composed of a composite polymeric material being transparent to radio frequency signals.

21. A pallet as set forth in claim 17 wherein, said compartment encloses a wireless pallet tracking apparatus.

22. A pallet as set forth in claim 17 wherein, said deck includes a top surface and a bottom surface and said compartment extends from said top surface, past said bottom surface and into an open area of interior space of said block structures.

23. A pallet as set forth in claim 17 wherein, said impact guards protect said block structures against impacts from the forks, jacks and equipment from four sides.

* * * * *